US005248265A

United States Patent [19]

Goto et al.

[11] Patent Number: 5,248,265

[45] Date of Patent: Sep. 28, 1993

[54] SEALABLE ELECTRICAL INTERCONNECTION ASSEMBLY

[75] Inventors: Kazuhiro Goto, Markham; Peter R. Swift, Courtice, both of Canada

[73] Assignee: The Whitaker Corporation, Wilmington, Del.

[21] Appl. No.: 983,989

[22] Filed: Nov. 30, 1992

[51] Int. Cl.[5] ..... H01R 13/00

[52] U.S. Cl. ..... 439/559

[58] Field of Search ..... 439/271-283, 439/548, 556, 559

[56] References Cited

U.S. PATENT DOCUMENTS

| | | | |
|---|---|---|---|
| 1,503,238 | 7/1924 | Gall | 439/559 |
| 4,335,932 | 6/1982 | Herrmann, Jr. | 339/218 M |
| 4,451,103 | 5/1984 | Buresh et al. | 339/93 R |
| 4,702,710 | 10/1987 | Dittman et al. | 439/548 |
| 4,998,894 | 3/1991 | Gronvall | 439/521 |
| 5,090,917 | 2/1992 | Noorily et al. | 439/395 |

*Primary Examiner*—Joseph H. McGlynn
*Attorney, Agent, or Firm*—Driscoll A. Nina, Jr.

[57] ABSTRACT

A sealable interconnection assembly for electrically connecting a conductor on one side of a composite panel, where the interconnection assembly is below or essentially flush with the surface of the composite panel and the conductor, to a lead on another side of the panel through a hole in the panel and over a range in panel thicknesses, wherein a housing is adapted to span the range of panel thicknesses and is sealed within the hole, a contact spans a passageway in the housing to electrically connect the conductor with the lead and a boot encapsulates the contact lead termination so that the contact is sealed from outside contamination.

15 Claims, 3 Drawing Sheets

SEALABLE ELECTRICAL INTERCONNECTION ASSEMBLY

FIELD OF THE INVENTION

This invention relates to sealed interconnection assemblies for electrically connecting a conductor of a device on one side of a composite panel to a wire lead on the opposite side of the panel.

BACKGROUND OF THE INVENTION

Numerous winter weather airplane accidents during take-off are attributed to an accumulation of snow or ice on an airplane's wings. This accumulation alters the aerodynamic characteristics of the airplane's outer surfaces and reduces the ability of an airplane's wings to produce the lift. One procedure for dealing with this accumulation is to de-ice the airplane by spraying the airplane with an ethylene glycol based solution prior to take-off.

In spite of the spraying procedure, accidents involving planes that have been de-iced have occurred. A number of these accidents have been traced to the time between de-icing and take-off exceeding the effective time of the de-icing procedure. Because delays are commonplace in winter flight operations, an airplane in line to take-off may exceed the effective time of de-icing and have to leave its place for further de-icing.

The delays associated with subsequent de-icing cause expense to the airplane's operators and significant passenger inconvenience. What is needed is to incorporate de-icing apparatus into the airplane so that while on the ground the wings may be kept clear of ice accumulation.

One solution is to incorporate a heater into the outer surface of the wing. However, the modern airplane wing is constructed of composite skin panels of varying thickness surrounding a basic wing structure, thereby making an electrical connection from one side to the other difficult.

What is needed is an electrical interconnection assembly for connecting a conductor of a device on the outside of the skin panel to a corresponding lead on the inside thereof. This interconnection assembly cannot adversely effect the structural integrity of the skin panel or the aerodynamic characteristics of the wing. The interconnection assembly must accommodate the different skin panel thicknesses associated with the various locations on the wing where the interconnection assembly is to be used while maintaining an environmental seal to prevent contamination to the panel structure and the connector.

SUMMARY OF THE INVENTION

In accordance with the present invention, an interconnection assembly is disclosed for electrically connecting a conductor on one side of a composite panel to a lead on the other side. The invention comprises a housing adapted to span a range of panel thicknesses and sealed within a hole through the composite panel; an electrical contact passing through the housing for connection with the conductor and the lead; and a sealable boot for sealably engaging the housing and covering the contact to prevent exposure of the contact, whereby the housing and the contact are in an essentially flush relationship with the conductor side of the panel.

It is an object of this invention to provide an interconnection assembly for electrically connecting a conductor of a device on one side of a composite panel to a lead on the other side of the panel. It is another object of this invention to be able to use the same interconnection assembly components over a variety of panel thicknesses. It is further object of this invention that the structural integrity of the panel is not compromised by the interconnection assembly. It is an additional object of this invention that the interconnection assembly remain essentially flush with the side of the panel on which the conductor is located.

It is a feature of this invention that the same telescoping sleeves may be used to accommodate the variety of panel thicknesses. It is another feature of this invention that the sleeves are potted in place to prevent contamination of the composite panel structure and to maintain structural integrity of the composite panel. It is a further feature of this invention that the connector is disposed within the telescoping sleeve and is adapted for electrically connecting a conductor on one side of the panel to a lead on the other side of the panel over the variety of panel thicknesses that the assembly accommodates. It is an additional feature of this invention that when assembled the connector is sealed from environmental contamination.

It is an advantage of this invention that telescoping sleeve assembly can be made of molded plastic. It is another advantage of the invention that the telescoping sleeves may be held in place against the panel by the connector for added rigidity.

DETAILED DESCRIPTION OF THE INVENTION

Figure 1:
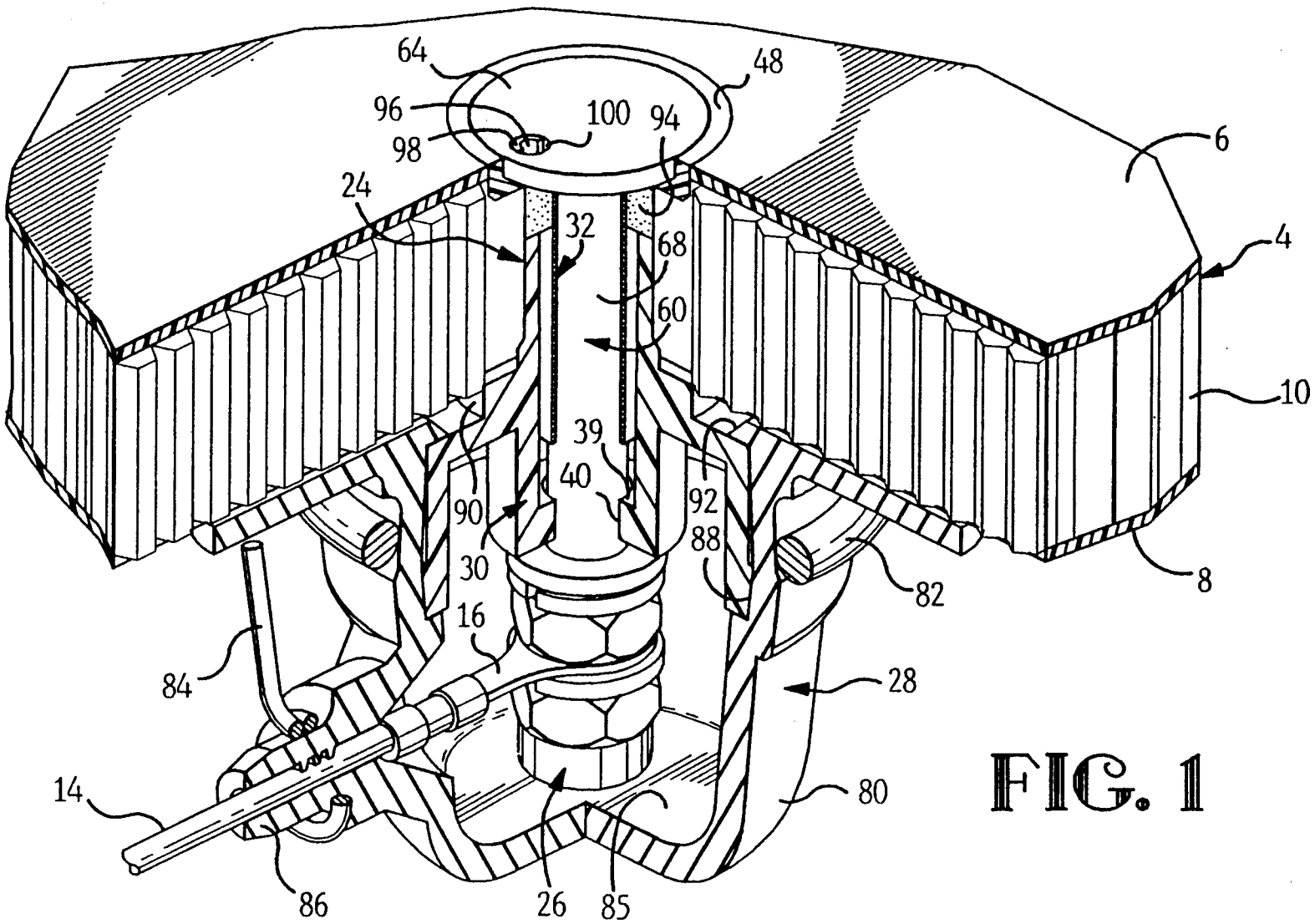
FIG. 1 is a partial cut-away side view of interconnection assembly installed in a composite panel.
Figure 2:
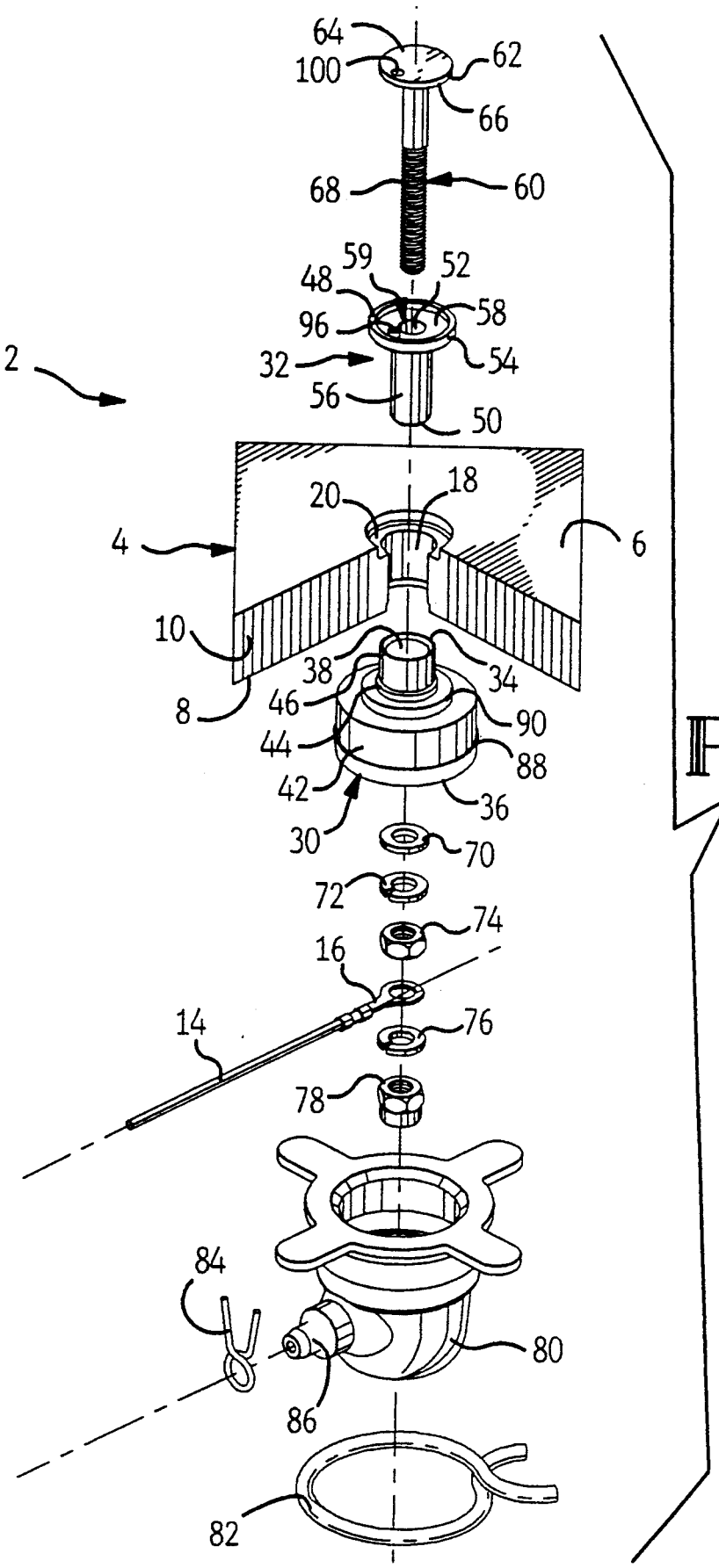
FIG. 2 is an exploded perspective view of the interconnection assembly.

The drawings show an interconnection assembly 2 incorporated into a composite panel 4. The composite panel is conventional and is made up of an outer skin 6, which corresponds to the outer surface of an airplane wing; an inner skin 8, which corresponds to the inner wing structure (not shown); and a core 10, generally of honey-combed structure, between the two skins.

Figure 3B:
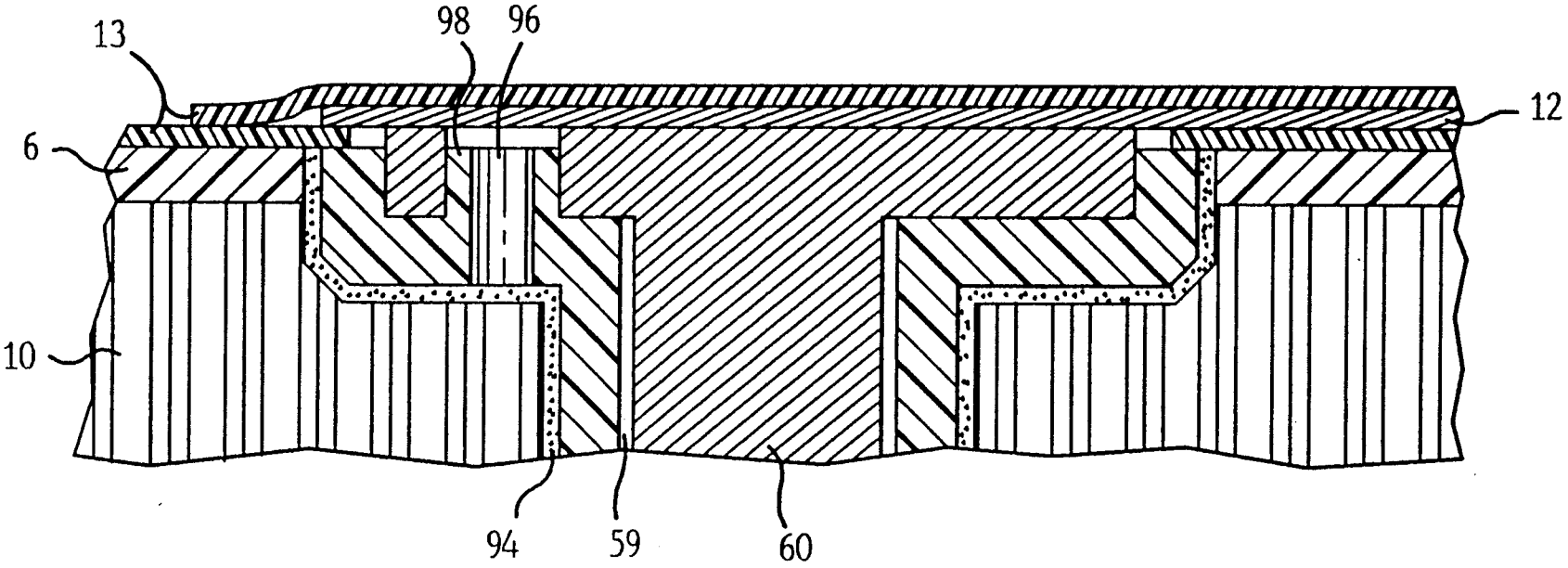
FIG. 3 is an enlarged cut-away side view of the interconnection assembly showing the electrical connection of the conductive contact to the conductor.

The interconnection assembly 2 connects a conductor 12, as best shown in FIG. 3, of a device (not shown) laminated between insulating layers 13 on the outer skin surface 6 to a lead 14 within the wing structure. In the embodiment shown in the drawings, the conductor 12 is a flat conductor and a ring-tongue terminal 16 is used to terminate the lead 14 and electrically connect the lead 14 with the interconnection assembly 2.

The interconnection assembly 2, as shown in the drawings, is contained within a hole 18 through the composite panel. Although in the drawings and the following description the elements are generally cylindrical in shape, the invention does not exclude other shapes which would interact in the manner described. The hole 18 has a generally concentric upper counter bore 20 extending inwardly towards the core 10 from the outer skin 6. The interconnection assembly 2 has a housing 24, a connector assembly 26, and a boot assembly 28.

The housing 24, in the embodiment shown in the drawings, comprises a lower sleeve 30 and an upper sleeve 32. The lower sleeve 30 extends into the hole 18 from the inner skin 8 while the upper sleeve 32 extends into the hole 18 from the outer skin 6. The upper sleeve 32 is adapted to be telescopically received by the lower sleeve 30. It would also be possible to adapt the sleeves 30,32 so that the lower sleeve 30 is telescopically received in the upper sleeve 32. The modifications to the elements would be apparent based on the following description which addresses only the embodiment having the upper sleeve 32 telescopically received by the lower sleeve 30.

The lower sleeve 30 has an upper end 34 within the hole 18, a lower face 36 below the inner skin 8 outside of the panel 4. An axial receiving bore 38 extends from the upper end 34 towards the lower face 36 forming a shoulder 39 where it meets a generally concentric lower guide bore 40 extending from the lower face 36 towards the upper end 34. A main body 42, adapted for connection with the boot assembly 28 as described below, surrounds the receiving bore 38 and lower guide bore 40 between the lower face 36 and the inner skin 8. A locating step 44, that is generally concentric with the receiving bore 38, extends from the main body 42 into the hole 18 in close alignment therewith. A receiving sleeve 46 of lesser diameter than the locating step 44 and generally concentric therewith, extends from the locating step 44 to the upper end 34.

The upper sleeve 32 has an upper face 48 essentially flush with the outer skin 6, a lower end 50 that extends within the receiving bore 38 of the lower sleeve 30, and an axial guide bore 52 extending therebetween. A flange 54, generally concentric with the guide bore 52, extends from the upper face 48 into the upper counterbore 20 in close alignment therewith. A mating sleeve 56 that is generally concentric with the flange 54 extends therefrom into the receiving bore 38 of the lower sleeve 30. A seat 58, generally concentric with the guide bore 38, extends into the upper face 48 of the upper sleeve 32.

When the two sleeves are within the hole and in telescopic engagement, a passageway 59 is defined extending between the upper surface and the lower surface of the sleeves. This passageway 59, in the embodiment shown in the drawings, is defined by the guide bore 52, the receiving bore 38 and the lower guide bore 40. The passageway 59 is adapted to be spanned by the connector assembly 26.

The construction of the upper sleeve 32 and the lower sleeve 30 is governed by the range of thicknesses of the panel 4 with which the interconnection assembly 2 is to be used. In the embodiment shown, the range of panel thickness is ⅝ inch to 1.0 inch. At the maximum thickness, the mating sleeve 56 of the upper sleeve 32 must be telescopically engaged within the receiving bore 38 of the lower sleeve 30. It is further required that at the minimum thickness, the upper end 34 of the lower sleeve does not extend into the upper counterbore 20 and that the shoulder 39 of the lower sleeve 30 and the lower end 50 of the upper sleeve 32 do not interfere, thereby preventing tightening of the sleeves 30,32 about the panel 4.

The upper sleeve and the lower sleeve may be machined or molded from a high-performance engineering plastic. The preferred plastic will have the following characteristics: high strength; dimensional stability; resistance to fuel, flame and other chemicals; low electrical conductivity and the ability to be bonded both to itself and the materials that make up the composite panel 4. A particularly suitable plastic is a glass reinforced polyetherimide manufactured by General Electric Company of Pitsfield, Mass. under the tradename ULTEM 2300.

The connector assembly 26 comprises a conductive contact 60 and fastener components 70–78 for electrically engaging the conductor 12 and the lead 14 through the upper sleeve 32 and the lower sleeve 30. The connector assembly may also be adapted for exerting a mechanical force on the sleeves 30,32 to pull the sleeves tightly against the panel 4. The contact 60 has a head 62 having a top surface 64 to be engaged with the conductor 12 and a bottom surface 66. The head 62 is adapted for a close fit within the seat 58 and to be essentially flush with the upper face 48 of the upper sleeve 32 when the bottom surface 66 is in contact with the seat 58, thereby locating the top surface 64 essentially flush with the outer skin 6. The desired goal is to minimize protrusion of the interconnection assembly 2 above the outer skin 6 of the panel 4 and especially the conductor 12. Therefore, it is within the spirit of the invention for the contact 60 to be located below the outer skin 6 if the conductor 12 is adapted to extend within the passageway 59 to engage the contact 60.

Extending from the bottom surface 66 of the head 62 is a threaded post 68. The post 68 passes through the panel 4 and the sleeves 30,32 which make up the housing in the embodiment shown, with in the passageway 59. A flat washer 70, a lock washer 72 and a first nut 74 are used to mechanically draw the sleeves 30,32 tightly against the outer skin 6 and inner skin 8 of the composite panel 4 by tightening the nut 74 on the threaded post 68 against the lower face 36 of the lower sleeve 30. The ring tongue connector 16 terminating the lead 14 is captivated in electrical engagement with post 68 by a lock washer 76 and a lock nut 78.

The post 68 is of sufficient length to assure that when the interconnection assembly 2 is being used with the maximum thickness panel 4 the post 68 extends from the lower sleeve 30 an amount sufficient to use the above mentioned fastener components 70–78. Additionally, the post 68 has sufficient length of thread to assure that when used with the minimum thickness panel, the first nut 74 does not run out of thread prior to drawing the sleeves 30,32 tightly against the panel 4.

The boot assembly 28 includes a boot 80, a large clamp 82 and a small clamp 84 for encapsulating the lower sleeve 30 where it extends from the inner skin 8 of panel 4, the post 68 and the attached fastener 70–78 —including the ring-tongue terminal 16 that terminates the lead 14 within a cavity 85 of the boot 80. The boot 80 is sealably clamped to the main body 42 of the lower sleeve 30 by the large clamp 82. The lead 14 enters the boot 80 through a radially disposed port 86 which is adapted to be sealably connected to the lead 14 by a small clamp 84. Although this embodiment uses clamps there are numerous other ways to sealably connect the boot to the main body 42 and the lead 14, including adhesive. However the clamps allow for easy disassembly and subsequent reassembly of the interconnection assembly if required.

The mating of the boot 80 to the lower sleeve 30 can be improved by incorporating a barb 88 into the main body 42 for engaging the cavity 86 of the boot 80 when the large clamp 82 is attached to the boot 80. The mating can also be enhanced by providing an undercut 90 where the main body 42 meets the inner skin 8 of the panel 4 for engaging a lip 92 of the boot 80.

The interconnection assembly 2 of the present invention as shown in the drawings is used by soldering the top surface 64 of the head 62 of the contact 60 to the conductor 12 to provide electrical connection therebetween. A hole 18 is formed through the panel 4 having a generally concentric upper counterbore 20 extending inwardly from the outer skin 6.

The upper sleeve 32 and the lower sleeve 34 are inserted into the hole 18 from the outer skin 6 side and the inner skin side 8 respectively. The mating sleeve 56 of the upper sleeve 32 is telescopically received by the receiving bore 38 of the lower sleeve 30. Sleeves 30,32 are sealed in place by a potting compound 94 that is compatible with both the sleeves 30,32 and the structure of the panel 4. A bleed hole 96 may be located within the seat 58 of the upper sleeve 32, thereby connecting the seat 58 with the annular volume between sleeves 30,32 and the hole 18 to bleed air and excess potting compound as the sleeves 30,32 are being pressed into place. The potting compound 94 seals the telescopically engaged mating sleeve 56 to the receiving bore 38. The size of the receiving bore 38 and the mating sleeve 56 are adapted so that the potting compound will not flow therebetween and escape into the passageway 59 while the sleeves 30,32 are being drawn together.

The threaded post 66 of the contact 60 is inserted into the guide bore 52 of the upper sleeve 32 and through the lower guide bore 40 of the lower sleeve 30. The head 62 may be located within the seat 58 by a tubular boss 98, which may be generally concentric with the bleed hole 96, that mates with an orientation hole 100 passing through the head 62. The contact 60 is secured in place by a flat washer 70, a lock washer 72 and a nut 74 installed on the threaded post 68 where it extends below the lower face 36 of the lower sleeve 30. By tightening the nut 74 on the threaded post 66 the upper sleeve 32 and the lower sleeve 30 are drawn tightly about the panel 4. The tubular boss 98 acts as a mechanical key to locate the contact 60 by mating with the orientation hole 100 therein and to prevent the contact from turning 60 when the fasteners 70–78 are being tightened on the post with the orientation hole 100 acts.

The lead 14 is passed through the port 86 and terminated with a ring-tongue terminal 16 electrically engaged with the contact 60 by a lock washer 76 and a lock nut 78. The boot 80 is then fitted around the termination and sealed around the main body 42 of the lower sleeve 30 and the lead 14 by the large clamp 82 and the small clamp 84 respectively.

It will be appreciated that the present invention has significant advantages for the electrical connection of a conductor on one side of a composite panel to a lead on the opposite side of panel. Although this invention was described in reference to a heater on the outer skin of the panel, this interconnection assembly may also be used with other electrical devices. It is also possible to use more than one interconnection assembly with devices that require a path from the inner side of the panel to the outer side and then back to the inner side, such as with a temperature sensor.

It should be recognized that the above described embodiment constitutes the presently preferred form and that the invention can take numerous other forms. Accordingly, the invention should be limited only as required by the scope of the following claims.

We claim:

1. A sealable interconnection assembly for electrically connecting a conductor on one side of a composite panel to a lead on another side of the panel over a range of panel thicknesses, through a hole in the panel that connects the respective sides, comprising:

a housing spanning the panel within the hole having an upper face essentially flush with the conductor side of the panel and a lower face disposed below the lead side of the panel and a passageway connecting said surfaces, said housing being potted within the hole using a compatible potting compound to bond said housing to the hole;

a contact assembly for electrically engaging the conductor and the lead extending through the passageway; and a boot that encapsulates the contact assembly where it is electrically connected to the lead, said boot being in sealed engagement with the housing where it extends below the lead side of the panel, said boot having a sealable port surrounding the lead where the lead enters the boot for electrical engagement with the contact.

2. The sealable interconnection assembly of claim 1, wherein the electrical engagement with the conductor is achieved by soldering the contact to the conductor.

3. The sealable interconnection assembly of claim 1, wherein the lead is electrically engaged with the contact by terminating the lead with a ring-tongue terminal which is then fastened to the contact assembly.

4. The sealable interconnection assembly of claim 1, wherein the boot is sealed to the housing by a clamp.

5. The sealable interconnection assembly of claim 1, wherein the port of the boot is sealed about the lead with a clamp.

6. The sealable interconnection assembly of claim 1, wherein the sleeve assembly is made of plastic.

7. The sealable interconnection assembly of claim 1, wherein the housing comprises an upper sleeve, inserted into the hole from the conductor side of the panel having the upper face, and a lower sleeve, inserted into the hole from the lead side of the panel having the lower face, said sleeves being telescopically engaged with each other.

8. The sealable interconnection assembly of claim 7, wherein the upper sleeve and the lower sleeve are made of molded plastic.

9. The sealable interconnection assembly of claim 7, wherein the sleeves are potted into the hole, said potting compound filling all voids between the hole and the sleeves.

10. The sealable interconnection assembly of claim 7, wherein the upper sleeve and the lower sleeve are adapted to exert a compressive force on the panel along the axis of the hole.

11. The sealable interconnection assembly of claim 10, wherein the contact assembly has a threaded post electrically and mechanically connected to the lead so that a fastener installed on the threaded post, below the lower face of the lower sleeve will draw the sleeves into a compressive relationship with the panel.

12. A sealable interconnection assembly for electrically interconnecting a conductor on the outer side of a composite skin panel on an airplane wing to a lead on the inner side of the panel through a hole interconnecting the sides, wherein the interconnection assembly is usable over a range of panel thicknesses and, once assembled, the conductor and the hole, on the conductor side of the panel, are overlapped and sealed to the panel by a lamination of material, comprising:

a housing having an upper sleeve inserted into the hole from the conductor side of the panel and having an upper face essentially flush therewith and a lower sleeve inserted into the hole from the lead side of the panel and having a lower face extending therebelow, wherein the sleeves are in telescopic engagement with each other and a passageway extends between said faces, said sleeves being bonded to each other and the hole;

a contact electrically engaged with the conductor and the lead spanning the housing within the sleeves, said contact being adapted to draw the sleeves tightly to the panel; and a boot for sealably encapsulating the termination of the lead and the contact where it extends from the lower face of the lower sleeve, thereby forming an environmentally sealed interconnection.

13. The sealable interconnection assembly of claim 12, wherein the sleeves are bonded together and to the hole by an adhesive and the upper sleeve has a bleed hole extending from the upper face into the hole in the panel and outside of the passageway, whereby air and excess adhesive may escape through the hole when the sleeves are pressed together.

14. The sealable interconnection assembly of claim 12, wherein the upper sleeve has a seat extending therein from the upper face and a boss extending from said seat back towards the upper face and the contact has an orientation hole adapted to mate with said boss, whereby the contact is located within the sleeve assembly and the contact is prevented from moving relative the upper sleeve.

15. A method for sealably electrically interconnecting a conductor laminated on one side of a composite panel to a lead on the other side of the panel, comprising the steps of:

forming a hole from one side of the panel to the other;

sealing a housing having a passageway therethrough about the hole thereby being essentially flush with the conductor side of the panel and extending below the lead side of the panel;

spanning the housing within the passageway by a contact;

drawing the housing flush against the sides of the panel;

electrically connecting the conductor to the contact such that it does not significantly extend above the conductor side of the panel; and sealably encapsulating the contact where it extends below the lead side of the panel and the connection of the contact with the lead at the lead side of the housing;

whereby the hole in the panel is sealed to the housing and the contact is sealed within the housing and the lead connection is encapsulated therein.

* * * * *